US007886762B1

(12) United States Patent
Carter

(10) Patent No.: US 7,886,762 B1
(45) Date of Patent: Feb. 15, 2011

(54) METHOD AND APPARATUS FOR PLUMBING A TUB AND SHOWER

(75) Inventor: Charles W. Carter, Kernersville, NC (US)

(73) Assignee: CWC Services, Inc., Kernersville, NC (US)

( * ) Notice: Subject to any disclaimer, the term of this patent is extended or adjusted under 35 U.S.C. 154(b) by 853 days.

(21) Appl. No.: 11/452,510

(22) Filed: Jun. 14, 2006

(51) Int. Cl.
*F16L 5/00* (2006.01)

(52) U.S. Cl. ..... 137/359; 137/377; 4/695

(58) Field of Classification Search ..... 137/359, 137/360, 377, 382, 315.12, 15.17; 4/654, 4/655, 657, 658, 695
See application file for complete search history.

(56) References Cited

U.S. PATENT DOCUMENTS

| | | | | | |
|---|---|---|---|---|---|
| 2,847,027 | A | * | 8/1958 | Kumpman | 137/597 |
| 2,922,563 | A | * | 1/1960 | Aldington | 206/508 |
| 3,167,855 | A | * | 2/1965 | Moen | 29/890.141 |
| 4,896,381 | A | * | 1/1990 | Hutto | 4/695 |
| 5,263,510 | A | * | 11/1993 | Heimann et al. | 137/359 |
| 5,497,584 | A | * | 3/1996 | Bergmann | 52/34 |
| 6,052,929 | A | * | 4/2000 | Canadas | 40/331 |
| 2005/0247347 | A1 | | 11/2005 | McNerney | 137/360 |

OTHER PUBLICATIONS

Porcher "Reprise: Two-Handle Bath and Shower Set with Thermostatic Valve," Porcher LTD, 2002.
"Two Way or three Way In-Wall Diverter: installation instructions," Jado Productss, 2003.
"Pressure Balanced Shower Valve with Check Stops," Jado Products, 2003.
"Ariana: Pressure Balance Tub and Shower Set," American Standard, 2004.
"Eternity Faucet Collection: Pressure Balance Tub/Shower Faucet;" Plumbmaster, Inc. 2004.
"Chipperfield: Pressure Balance Temperature Control Valve;" Porcher , LTD., 2004.
Specifications Submittals & Parts Explosions: 2004 New Products Supplements, Price Pfister, p. 18. 2004.

* cited by examiner

*Primary Examiner*—Stephen Hepperle
*Assistant Examiner*—Macade Brown
(74) *Attorney, Agent, or Firm*—MacCord Mason PLLC

(57) ABSTRACT

An apparatus for maintaining a tub and shower valve in a desired position during construction of a bathroom prior to the tub and shower being ready to be trimmed out. The apparatus includes a base in the form of a planar plate having an opening for receiving a portion of the valve and an aperture for receiving a fastener; and a flange for handling the apparatus attached to the base. The method includes roughing in a tub and shower valve, securing the valve in place with a special fitting, removing the special fitting, and installing the trim package to finish the tub and shower.

4 Claims, 6 Drawing Sheets

METHOD AND APPARATUS FOR PLUMBING A TUB AND SHOWER

BACKGROUND (1) Field of the Disclosure

This disclosure relates generally to a method of plumbing a tub and shower, and also to a special fitting for performing the method.

(2) Description of Prior Art

The commercial process of new home construction on site may require that the vertical studs of bathroom walls be erected prior to installation of the type of bath and shower tub that extends vertically beyond the height of water flow control fixtures. In such cases, plumbing to the tub, including a valve for controlling the flow of water to the tub and shower may be 'roughed in' prior to the installation of drywall or other finished wall material. This roughing in process is generally performed by a plumber that visits the site of the construction and then leaves the roughed in tub and shower until drywall installers, painters, electricians and the like complete their work in the bathroom. The plumber then returns to finish the tub and shower with trim pieces such as showerheads, tub spouts, tub and shower valve controls and the like.

FIG. 1 shows a roughed in tub and shower 10 including a valve 25 connected to a water line 71 for a showerhead and a water line 72 for a tub spout. The valve 25 is not secured in place in FIG. 1 and is therefore subject to becoming displaced during the plumber's absence to a position behind the tub 64 where the valve 25 is not accessible for attaching trim pieces when the plumber returns. To prevent this displacement from occurring, it is common to attach with a pair of fasteners a finish trim piece 49 to the valve 25 on the inside of the tub 64, which is installed against the wall studs 83, as shown in FIGS. 2 and 3.

While this process has proven be satisfactory for securing the valve 25 in place, the trim piece 49 is often damaged during work performed in the bathroom by other workers during the plumber's absence. Also, the plumber may be required to purchase the trim piece 49 as part of a larger package prior to roughing in the tub and shower, and stock the remainder of the pieces in the larger package until the bathroom is ready to be trimmed out, which often leads to loss of or damage to some of the pieces in the larger trim package. Furthermore, if a homebuyer purchases the home in the interim and desires a different trim package than that of the one installed during roughing in, a different one of the larger packages may have to be ordered and the trim piece 49 replaced. Thus, there is a need for a method for plumbing a tub and shower of a new home construction that overcomes these problems.

SUMMARY

This disclosure provides an improved method of plumbing a tub and shower, and also provides embodiments of a special fitting for performing the improved method. The method includes roughing in a tub and shower valve and securing the valve in place in a tub with a special fitting, which may take the form of a plate having flanges connected thereto at obtuse angles so that a plurality of the fittings can be stacked in nested relationship. The method also includes waiting until drywall or other finish walls are installed and ordering a trim package for the tub and shower. The special fitting is removed and the trim package installed to finish the tub and shower. This process may avoid the expense of stocking the trim package during the interim between roughing in and finishing the shower.

DESCRIPTION OF THE PREFERRED EMBODIMENTS

Figure 1:
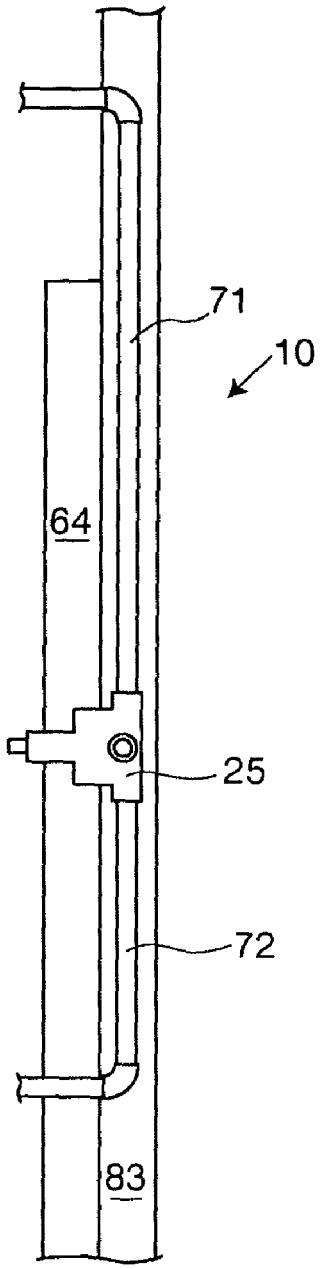
FIG. 1 is a side view of a bathroom wall showing a tub and shower.

In the following description, like reference characters designate like or corresponding parts throughout the several views. Also in the following description, such terms as "forward," "left," "upwardly," and the like are words of convenience and are not to be construed as limiting terms. Furthermore, the illustrations and descriptions provided are for describing embodiments of methods and apparatuses for plumbing tubs and showers and are not for limiting the methods and apparatuses to any particular embodiment shown or described.

Figure 2:
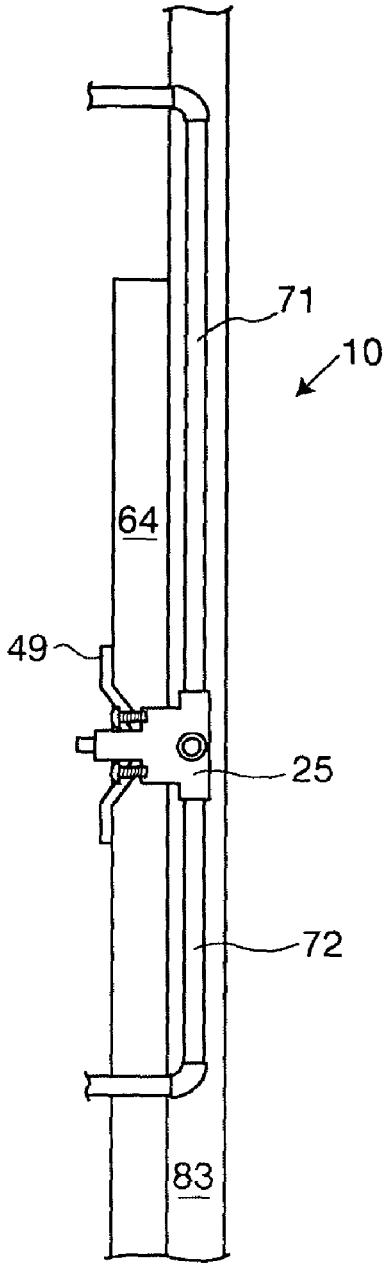
FIG. 2 is also a side view of the bathroom wall.
Figure 3:
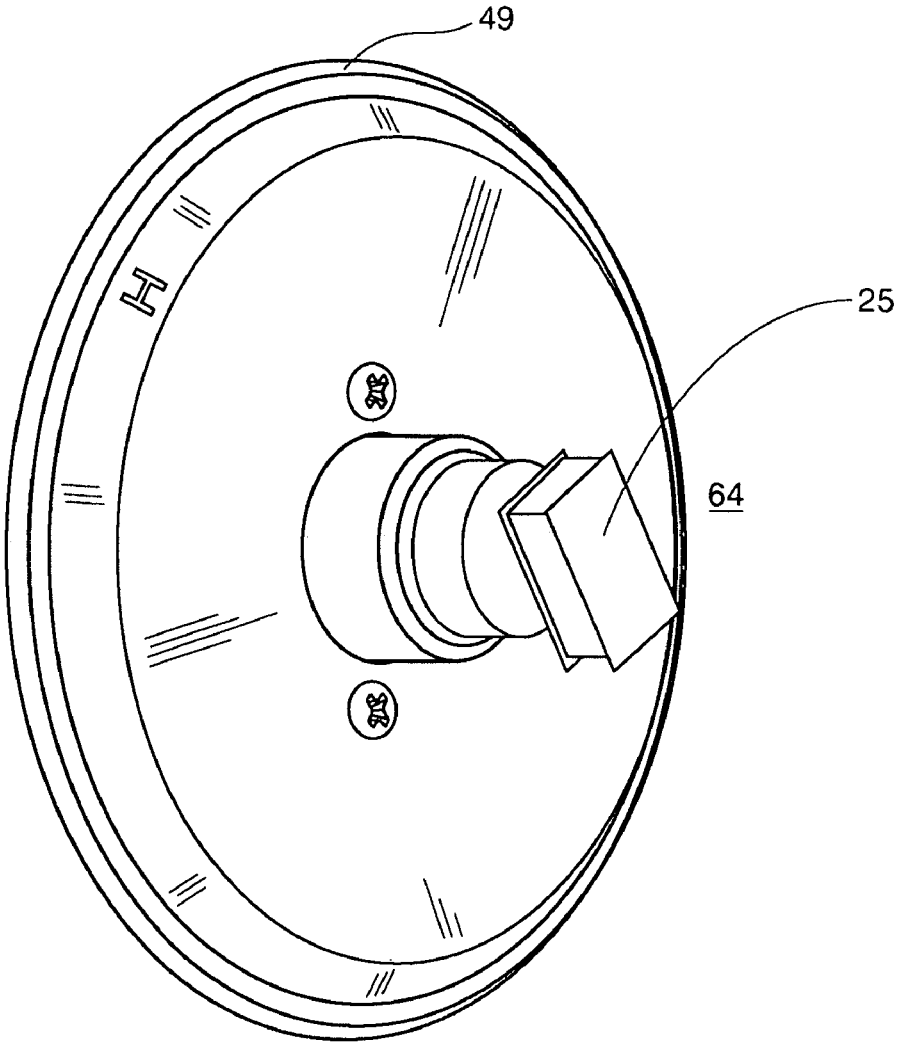
FIG. 3 is a front perspective view of a trim piece for a tub and shower valve.
Figure 4:
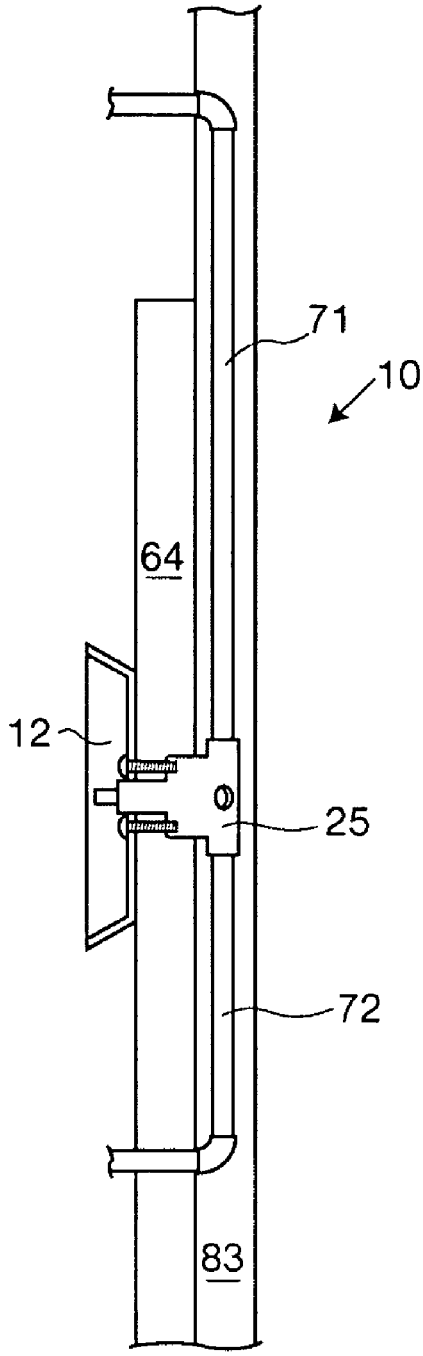
FIG. 4 is another side view of the bathroom wall.
Figure 5:
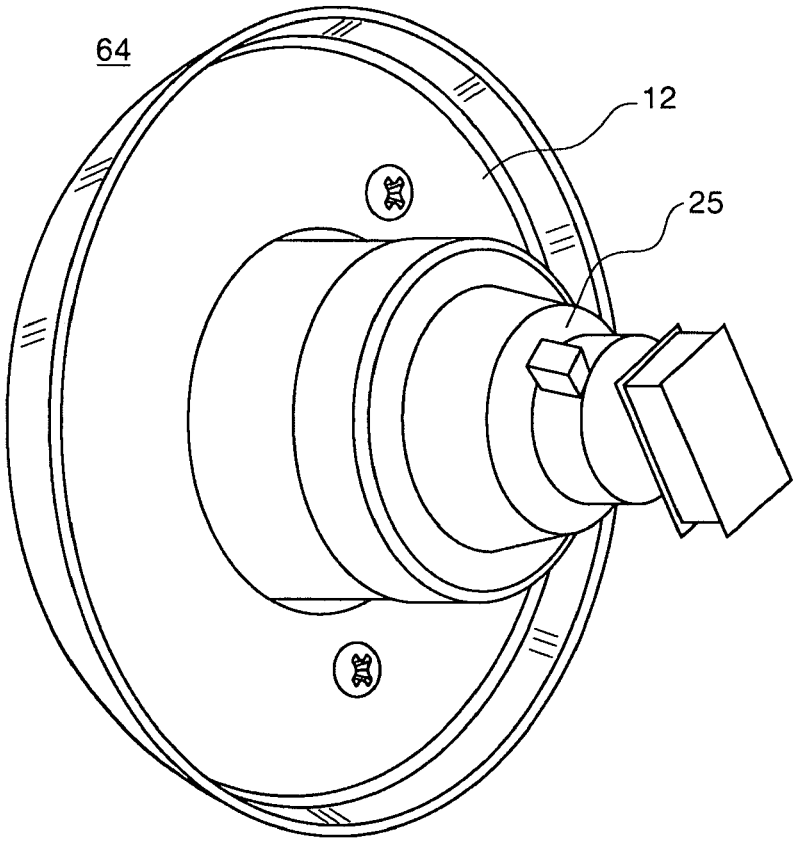
FIG. 5 is a front perspective view of a tub showing a valve and a special fitting for securing the valve in the tub.

FIGS. 4 and 5 illustrate a method of plumbing a tub and shower 10 using a special fitting 12 for securing a tub and shower valve 25 in position in the tub 64. With reference again to FIG. 1, the valve 25 is in position in the tub 64 but is subject to being displaced. In FIG. 4, a special fitting 12, rather than the trim piece 49 shown in FIGS. 2 and 3, is attached to the valve 25 to secure it in place in the tub 64 and FIG. 5 is an enlarged view of the tub 64 with the special fitting 12 installed. By using the special fitting 12, the expense of purchasing the piece 49, and thus, the larger package of trim pieces, which typically includes a showerhead and tub spout, before roughing in the bath and shower, can be avoided.

Figure 6:
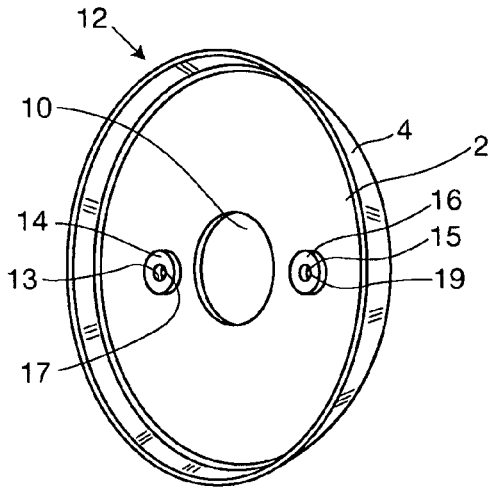
FIG. 6 is an enlarged front perspective view of the special fitting.

FIG. 6 is a front perspective view of an embodiment of the fitting 12 showing a base 2 in the form of a plate that is a substantially planar disk having an opening 10 for receiving the valve and apertures 13 and 15 for receiving fasteners. Collars 14 and 16 are attached to the base 2 to form another pair of apertures 17 and 19 disposed in coaxial relationship with apertures 13 and 15. The embodiment of the fitting shown in FIG. 6 also includes a flange 4 circumscribing the base 2 and extending outwardly there from to facilitate handling the fitting 12.

Figure 7:
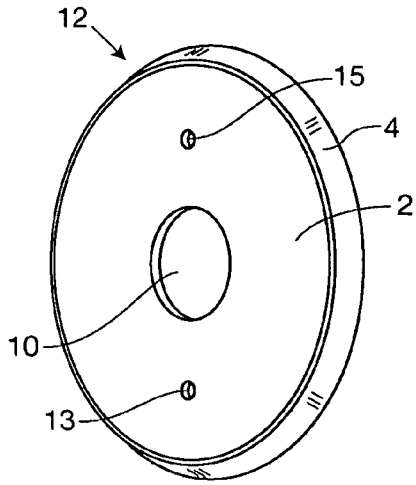
FIG. 7 is a rear perspective view of the fitting.

FIG. 7 is a rear perspective view of the embodiment of the fitting 12 showing the base 2 attached to the flange 4. The base includes the apertures 13 and 15 for receiving fasteners.

Figure 8:
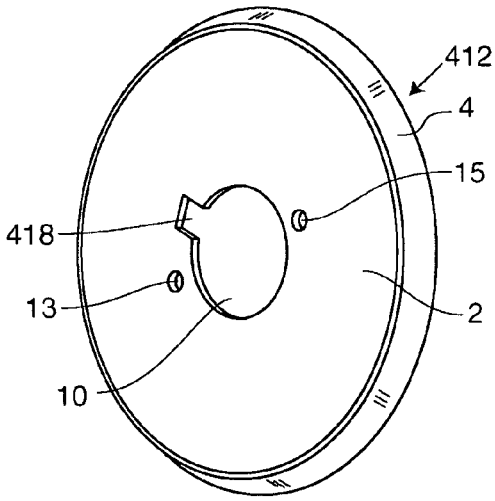
FIG. 8 is a rear perspective view of an alternative embodiment of the fitting.
Figure 9:
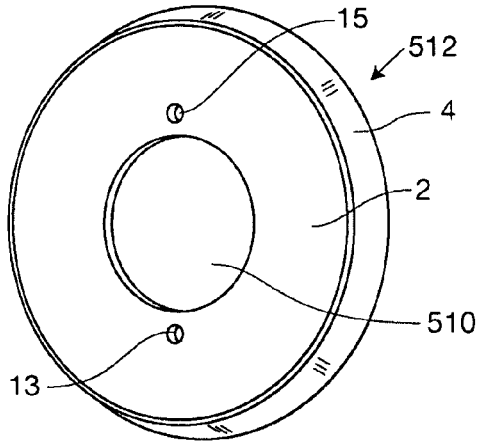
FIG. 9 is a front perspective view of an alternative embodiment of the fitting.

FIGS. 8 and 9 show additional embodiments 412 and 512 of the fitting 12. The opening 10 formed by the fitting 412 includes an indentation 418.

Figure 10:
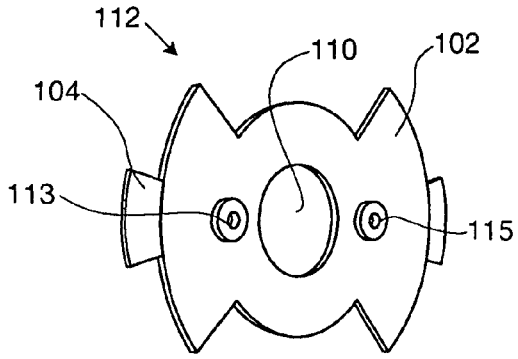
FIG. 10 is a front perspective view of an alternative embodiment of the fitting.

FIG. 10 shows another embodiment of the special fitting 112 that can also be used to perform the method. The fitting 112 shown in FIG. 8 also includes a base 102 including an opening 110 for receiving a portion of a valve and apertures 113 and 115 for receiving fasteners. The fitting 112 also includes and a flange 104 attached to the base 102.

Figure 11:
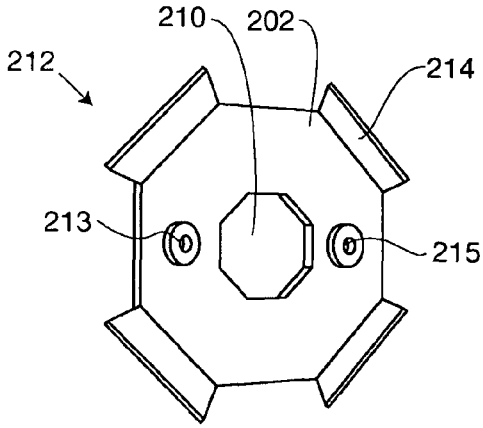
FIG. 11 is a front perspective view of an alternative embodiment of the fitting.

FIG. 11 is another embodiment of the special fitting 212 showing a base 202 including an opening 210 and apertures 213 and 215 for receiving fasteners. The fitting 212 also includes a flange 214 attached to the base 202.

Figure 12:
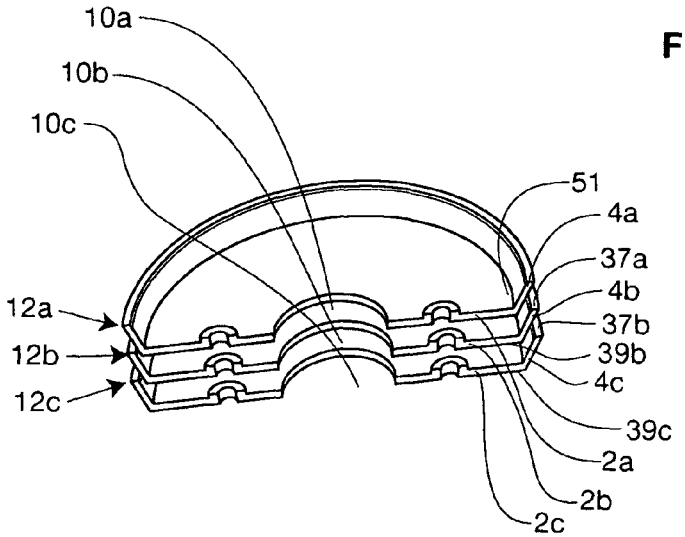
FIG. 12 is a front perspective cross section of a plurality of fittings stacked in nested relationship.

FIG. 12 shows a plurality of the special fittings 12*a*, 12*b* and 12*c* stacked with each fitting above the bottom one nested in the fitting below. Each flange 4*a*, 4*b* and 4*c* is attached to a base 2*a*, 2*b* or 2*c* in a manner that forms an obtuse angle, such as the angle 51, between the flange 4*a* and the base 2*a* to which it is attached. This permits the bases 2*a* and 2*b* of the fittings 12*a* and 12*b*, respectively, to be disposed above and in substantially parallel relation to the bases 2*b* and 2*c*, in substantially horizontal planes that are above the bottom edges 39*b* and 39*c* of the bases 2*b* and 2*c*, respectively. The planes are also below the top edges 37*b* and 37*c*, respectively, of the flanges 4*b* and 4*c* attached to the bases 2*b* or 2*c* below, while the openings 10*a*, 10*b* and 10*c* in the bases 2*a*, 2*b* and 2*c* are in substantially coaxial relationship with one another.

Certain modifications and improvements will occur to those skilled in the art upon a reading of the foregoing description. All such modifications and improvements have not been described herein for the sake of conciseness and readability but may nonetheless properly fall within the scope of the appended claims.

I claim:

1. A method comprising the steps of:

installing a tub and shower valve in a bathroom;

securing the valve in place in a tub with an apparatus prior to the tub and shower being ready to be trimmed out, said base of the apparatus of the apparatus being larger than the opening through which the valve extends into the tub and shower whereby the valve is secured in place until the tub and shower is trimmed out;

ordering a trim package including a plurality of trim pieces for the bathroom;

waiting until the bathroom finished walls are installed;

removing the entire apparatus; and installing the trim pieces from the trim package in the bathroom, wherein said apparatus comprises a base in the form of a planar plate having an opening for receiving a portion of the valve and an aperture for receiving a fastener, said base being larger than an opening through which the valve extends into the tub and shower whereby the valve is secured in place until the tub and shower is trimmed out; and a flange for handling the apparatus attached to the base, said flange circumscribing a portion of the base, and extending from the base to form an obtuse angle between the base and the flange.

2. The method of claim 1 further comprising storing the apparatus in nested relationship with a like apparatus.

3. The method of claim 2, wherein removing the apparatus comprises removing a pair of fasteners securing the apparatus to the valve.

4. The method of claim 3, wherein installing the trim pieces comprises securing a trim piece to the valve.

* * * * *

UNITED STATES PATENT AND TRADEMARK OFFICE

CERTIFICATE OF CORRECTION

PATENT NO. : 7,886,762 B1
APPLICATION NO. : 11/452510
DATED : February 15, 2011
INVENTOR(S) : Charles W. Carter It is certified that error appears in the above-identified patent and that said Letters Patent is hereby corrected as shown below:

In Column 1, Line 38, the word "to" should appear after proven

In Column 4, Line 6, delete the second occurrence of "of the apparatus"

Signed and Sealed this
Fifth Day of April, 2011

David J. Kappos

David J. Kappos
*Director of the United States Patent and Trademark Office*